US010712006B2

(12) United States Patent
Clemen et al.

(10) Patent No.: US 10,712,006 B2
(45) Date of Patent: Jul. 14, 2020

(54) COMBUSTION CHAMBER ARRANGEMENT OF A GAS TURBINE AND AIRCRAFT GAS TURBINE

(71) Applicant: Rolls-Royce Deutschland Ltd & Co KG, Blankenfelde-Mahlow (DE)

(72) Inventors: Carsten Clemen, Mittenwalde (DE); Torsten Voigt, Berlin (DE); Thomas Doerr, Berlin (DE)

(73) Assignee: ROLLS-ROYCE DEUTSCHLAND LTD & CO KG, Blankenfelde-Mahlow (DE)

( * ) Notice: Subject to any disclaimer, the term of this patent is extended or adjusted under 35 U.S.C. 154(b) by 301 days.

(21) Appl. No.: 15/726,043

(22) Filed: Oct. 5, 2017

(65) Prior Publication Data

US 2018/0100650 A1 Apr. 12, 2018

(30) Foreign Application Priority Data

Oct. 6, 2016 (DE) ..... 10 2016 219 424

(51) Int. Cl.
*F23R 3/06* (2006.01)
*F23R 3/00* (2006.01)
(Continued)

(52) U.S. Cl.
CPC ..... *F23R 3/06* (2013.01); *F23R 3/002* (2013.01); *F23R 3/10* (2013.01); *F23R 3/286* (2013.01);
(Continued)

(58) Field of Classification Search
CPC .... F23R 3/06; F23R 3/002; F23R 3/10; F23R 2900/03044
See application file for complete search history.

(56) References Cited

U.S. PATENT DOCUMENTS 6,070,412 A 6/2000 Ansart et al.
6,513,331 B1 * 2/2003 Brown ..... F23R 3/06 60/754
(Continued)

FOREIGN PATENT DOCUMENTS

EP 1351022 A2 10/2003
EP 2292977 A2 3/2011
(Continued)

OTHER PUBLICATIONS

European Search Report dated Feb. 9, 2018 for counterpart European Application No. 17194774.0.
(Continued)

*Primary Examiner* — William H Rodriguez
(74) *Attorney, Agent, or Firm* — Shuttleworth & Ingersoll, PLC; Timothy J. Klima

(57) ABSTRACT

A gas turbine combustion chamber includes first admixing air holes having first inner and outer center points, and second admixing air holes having second inner and outer center points. The first and second inner center points respectively lie on a side of the first and second admixing air holes oriented towards the combustion chamber. The first and second outer center points lie on a side of the first and second admixing air holes facing away from the combustion chamber. An equation $L=D2/D1*(D2-D1)/C^2$ is fulfilled, with L being a distance between the first and second inner center points and/or the first and second outer center points; D1 and D2 being flow diameters of the first and second admixing air holes respectively at an entry and/or exit side to the combustion chamber and C being an average flow rate coefficient of the first and second admixing holes.

18 Claims, 8 Drawing Sheets

Figure 1:
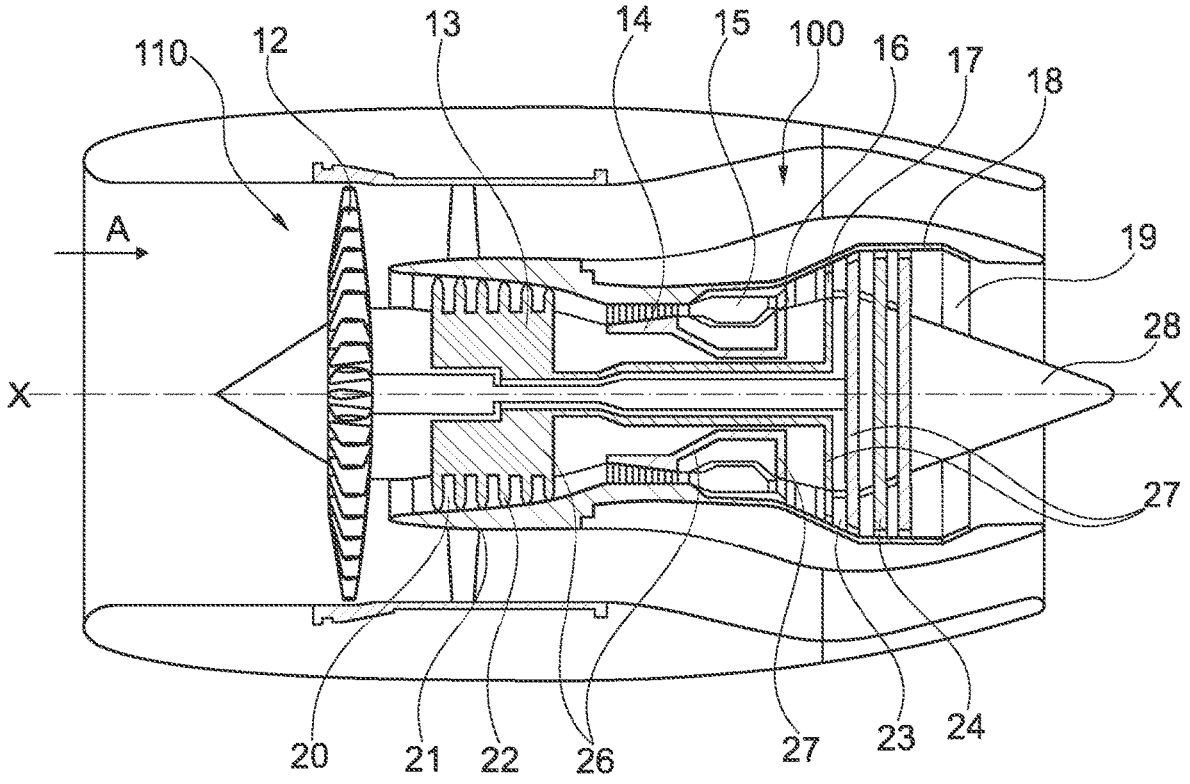

(51) Int. Cl.
*F23R 3/10* (2006.01)
*F23R 3/28* (2006.01)

(52) U.S. Cl.
CPC ... *F23R 2900/03044* (2013.01); *Y02T 50/675* (2013.01)

(56) References Cited

U.S. PATENT DOCUMENTS

| | | | | |
|---|---|---|---|---|
| 6,715,292 | B1 | 4/2004 | Hoke | |
| 7,059,133 | B2 | 6/2006 | Gerendas | |
| 9,279,588 | B2 | 3/2016 | Commaret et al. | |
| 9,328,665 | B2 | 5/2016 | Doerr et al. | |
| 9,765,970 | B2 | 9/2017 | Bourgois et al. | |
| 2001/0004835 | A1 | 6/2001 | Alkabie et al. | |
| 2006/0059918 | A1* | 3/2006 | Caldwell | F23R 3/06 60/772 |
| 2006/0099080 | A1 | 5/2006 | Lee et al. | |
| 2007/0084219 | A1* | 4/2007 | Bernier | F23R 3/002 60/804 |
| 2008/0010992 | A1* | 1/2008 | Patterson | F23R 3/06 60/772 |
| 2011/0048024 | A1 | 3/2011 | Snyder et al. | |
| 2012/0186222 | A1 | 7/2012 | Commaret et al. | |
| 2016/0178198 | A1 | 6/2016 | Gerendas | |

FOREIGN PATENT DOCUMENTS

| | | | |
|---|---|---|---|
| EP | 2693120 | A2 | 2/2014 |
| FR | 2981733 | A1 | 4/2013 |

OTHER PUBLICATIONS

German Search Report dated May 15, 2017 from counterpart German App No. 102016219424.0.

* cited by examiner

COMBUSTION CHAMBER ARRANGEMENT OF A GAS TURBINE AND AIRCRAFT GAS TURBINE

This application claims priority to German Patent Application 102016219424.0 filed Oct. 6, 2016, the entirety of which is incorporated by reference herein.

DESCRIPTION

The present invention relates to a combustion chamber arrangement, in particular to an aircraft gas turbine, as well as to a gas turbine with a combustion chamber arrangement.

Gas turbines with combustion chambers are known from the state of the art in different designs. The combustion chamber may for example be embodied in an annular manner with an inner and an outer combustion chamber wall. At the combustion chamber head, fuel is supplied by means of a plurality of fuel nozzles. Admixed air holes, which supply admixed air to the combustion chamber for a complete combustion of the fuel, are provided in the combustion chamber walls. Further, cooling air openings are provided in the combustion chamber walls, wherein in double-walled combustion chamber walls so-called impingement cooling holes are provided in the outer wall, and effusion cooling holes are provided in the inner wall of the double-walled combustion chamber wall. These cooling holes form a cooling air film to protect the combustion chamber walls from the hot combustion gases. As is for example known from US 2011/0048024 A1, the admixing air holes are arranged in a row along the circumference of the combustion chamber walls. At that, admixing air holes with a larger and a smaller diameter are arranged in an alternating manner. Further, cooling air holes are arranged in a second row along the circumference at a very small distance to the admixing air holes in the circumferential direction, in a manner offset with respect to the admixing air holes. With such combustion chambers, NOx emissions represent a problem area.

It is the objective of the present invention to provide a combustion chamber arrangement as well as a gas turbine that facilitates an improved admixture of air to a combustion chamber so as to significantly reduce the generation of NOx.

This objective is achieved through a combustion chamber arrangement with features as disclosed herein as well as a gas turbine with features as disclosed herein. Exemplary embodiments are disclosed below.

The combustion chamber arrangement of a gas turbine comprises an annular combustion chamber with an inner ring wall and an outer ring wall. Arranged at one end of the combustion chamber is a combustion chamber head with a plurality of fuel nozzles that introduce fuel into the combustion chamber. Further, a first admixed air row and a second admixed air row are provided. The first admixed air row comprises a plurality of first admixing air holes that are embodied as passage holes, wherein the first admixing air holes are arranged in the inner ring wall and/or the outer ring wall. The second admixed air row comprises a plurality of second admixing air holes that are also embodied as passage holes, which are also arranged in the inner ring wall and/or the outer ring wall. Admixed air is introduced into the combustion chamber via the admixing air holes of the first and second admixed air row. In order to significantly reduce NOx emissions during operation, the first and second admixing air holes are arranged in such a manner that the equation $L=D2/D1*(D2-D1)/C^2$ is fulfilled. The first admixing air holes have first inner and first outer center points, and the second admixing air holes have second inner and second outer center points. Here, the inner center points are respectively located at a side of the admixing air holes that is oriented towards the combustion chamber. The inner center points thus form the piercing points of the respective central axes of the admixing air holes to the combustion space. The outer center points are located at a side of the admixing air holes that is facing away from the combustion chamber.

In the equation, L is a distance between the first and second inner center points and/or the first and second outer center points of the first and second admixing air holes. D1 is a first flow diameter of the first admixing air holes at an entry side and/or an exit side to the combustion chamber, and D2 is a second flow diameter of the second admixing air holes at the entry side and/or exit side to the combustion chamber. Further, the second flow diameter D2 is larger than the first flow diameter D1. Further, C is an average flow rate coefficient of the first and second admixing air holes. The average flow rate coefficient C of an admixing air hole is a measure for the effective stream tube through the admixing air hole and thus describes what portion of a cross sectional area of the admixing air hole is passed on average by a flow from the inflow side to the outflow side. Through this arrangement of the exit flow cross sections of the admixing air holes into the combustion space as well as of the distance L of the admixed air into the axial direction of the combustion chamber, significant improvements in the NOx emissions can be achieved. By observing this arrangement requirement for the admixing air holes, efficient leaning of the fuel-air mixture in the combustion chamber can be achieved, so that no areas with fuel, which have a negative impact on NOx emissions, are present in the combustion chamber. Through the targeted arrangement of the admixing air holes according to the above-described equation, steady leaning can be achieved in the axial direction through the combustion chamber. In this manner, in particular NOx emissions can be optimally reduced, and a complete combustion of the supplied fuel can be achieved.

The flow rate coefficient of an admixing hole represents a measure for the effective stream tube through the admixing hole, and thus describes which portion of the admixing hole cross-sectional surface is passed on average by the flow from the annulus to the flame tube. The mass flow (impulse flow) that is put through such an admixing hole depends on the applied driving pressure gradient across the admixing hole, on the form and shape of the admixing hole, and on the Reynolds and Mach number. What is understood here by the form and shape of an admixing hole is the average cross-sectional shape (e.g. circle, ellipse), the inlet geometry at the upstream end of the admixing hole (e.g. rounded inlet or stepped inlet), the orientation of the hole relative to the flow (relevant with non-circular cross-sectional shapes and with circular cross-sectional shapes that have a central angulation relative to the surface (outer channel structure (annulus)/combustion chamber (flame tube)), which is not perpendicular to the surface), as well as the effective guide length of the admixing holes. What is understood by an effective guide length here is a length which leads to an improved guiding of the flow inside the admixing hole. This can be obtained by lengthening the hole in such a way that the admixing hole (not necessarily identically across the circumference) projects into the flame tube; but an elongation of the effective flow control can also be obtained already through a cooling arrangement based on the structural design, a liner shingle arrangement. The flow rate coefficient is a variable that can differ for every admixing hole, since the dependence on the flow state has an influence upstream and downstream of the admixing hole in addition to the already mentioned influence quantities. For example, in a rich-lean combustion chamber arrangement, the inflow state to the admixing hole is influenced by components such as the injector, the injector arm, mechanical components that depend on the cooling pattern, such as for example screws in the case of a liner shingle cooling, where applicable by structurally relevant structural components such as fastening pins and ignition devices. Likewise, design deviations and cooling differences, such as they for example occur in a shingled combustion chamber between the shingles, are decisive for the homogeneity of the incident flow. In addition, the flow is influenced by uncontrollable leakage flows which occur due to the assembly and manufacture that is subject to tolerances. Since the rich-lean combustion chamber mostly has a flow control in the form of an inlet hood about the injector and towards the annuli, the geometrical variations of such an inlet hood and the acceleration conditions around such a hood are also decisive for the formation of a flow profile inside the annulus. What is common to all mentioned influencing factors is that the inflow state is neither homogenous in the radial nor in the circumferential direction, which influences the flow rate coefficient of an admixing hole. [These considerations are not limited to the conditions upstream of the admixing hole, since an admixing hole can lie on all sides, that is, for example also downstream of the inlet.] With respect to the flow rate coefficient, it also has to be differentiated whether what is present is an individual admixing hole or multiple admixing holes. The latter case is the case which is relevant for the present invention. In the case of multiple admixing holes, the flow rate coefficient depends on how the admixing holes are oriented and arranged relative to each other, as every admixing hole itself influences the flow inside the annulus and inside the flame tube. In the flame tube, it is in particular decisive whether the jets of neighboring admixing holes interact. Here, the jets of different admixing holes can for example combine to form a common jet, the jet trajectory can differ from the nominal course because of the pressure field that is formed with the jet, and not least it has to be differentiated whether jets of the facing annuli interact with each other. The present invention takes into account admixing arrangements of facing annuli that lead to configurations according to which jets are substantially guided past each other, but also configurations according to which jets are arranged so as to be arranged facing each other. The flow inside the flame tube of a rich-lean combustion chamber is twisted, highly turbulent, and has local differences in temperature and thus also differences in density due to the locally varying thermal release. The turbulence influences the viscous behavior of the flow, and the differences in density lead to an inhomogeneous impulse distribution. These properties are decisive for the pressure field in the flame tube, and thus for the driving pressure gradient of the flow through the admixing hole, i.e. for the flow rate coefficient of an admixing hole.

It is to be understood that, according to the invention, the term flow diameter is not limited to the circle diameter, but rather a flow diameter according to the invention can be understood to be a circle diameter as well as an ellipse diameter. At that, the ellipse diameter is calculated according to the equation $D1=4*a1*b1/(a1+b1)$, wherein a1 and b1 are the semi-axes of an ellipse.

Preferably, the first flow diameter is a first circle diameter of the first admixing air holes. Alternatively, the first flow diameter is a first ellipse diameter of the first admixing air holes.

The second flow diameter D2 can also be a second circle diameter of the admixing air holes or a second ellipse diameter of the second admixing air holes.

The average flow rate coefficient C is a measure for the average effective through-flow of all admixing air holes, and preferably lies in a range of 0.60 to 0.75, and in an especially preferred case is 0.69.

Further, the first flow diameter and/or the second flow diameter are preferably different within the respective admixed air rows, wherein in that case the first flow diameter or the second flow diameter is determined as the mean value of the differently sized first and second flow diameters for each admixed air row.

An especially good inflow of the admixed air through the first and second admixing air holes is obtained if the flow diameters of the first and second admixing air holes are constant in the through-flow direction through the admixing air holes.

Further, it is preferred that the number of first and second admixing air holes is equal at the outer ring wall and/or at the inner ring wall.

According to an especially preferred embodiment of the present invention, a number of the first admixing air holes is equal to twice the number of fuel nozzles.

An especially good NOx reduction is obtained if the second admixing air holes at the outer ring wall and/or at the inner ring wall are arranged so as to be offset in the circumferential direction with respect to the first admixing air holes. At that, the second admixing air holes are especially preferably offset with respect to the first admixing air holes in such a manner that the second admixing air holes are positioned centrally between the first admixing air holes in the circumferential direction with the axial distance L.

Preferably, the first admixing air holes in the outer ring wall are arranged in the through-flow direction of the combustion chamber respectively on a central axis of a fuel nozzle, and the first admixing air holes in the inner ring wall are offset in the circumferential direction by an angle $\alpha=360°/(2*N1)$, wherein N1 is the number of the admixing air holes of the first admixed air row. Alternatively, the first admixing air holes in the inner ring wall are arranged in the through-flow direction of the combustion chamber respectively on a central axis of a fuel nozzle, and the first admixing air holes in the outer ring wall are offset in the circumferential direction by an angle $\alpha=360°/(2*N1)$, wherein N1 is the number of the admixing air holes of the first admixed air row. Through this arrangement requirement, it is ensured that the admixed air of the first admixed air row as far as possible comes into contact directly with the fuel that is discharged from the fuel nozzle, and that a very good mixing is realized.

A further reduction in NOx emissions can be achieved if the first admixing air holes have first central axes that lie in a first plane, and the second admixing air holes have second central axes that lie in a second plane. At that, the first and second plane are preferably arranged in parallel to each other. Especially preferably, the first and second central axes of the first and second admixing air holes are perpendicular to a middle cone of a conical combustion chamber.

Preferably, the first and/or second central axes are perpendicular to a tangent at the inner ring wall and/or perpendicular to a tangent at the outer ring wall of the combustion chamber.

Alternatively, the combustion chamber has a barrel-like ring shape with a barrel-like middle shell surface, and the first and second central axes of the first and second admixing air holes are arranged perpendicular to the barrel-like middle shell surface.

Preferably, the combustion chamber has a barrel-like shape, and/or the first and/or second admixing air holes have a central axis that is arranged at an angle not equal to 90° with respect to a tangent at the outer ring wall of the combustion chamber.

Further, the NOx emissions can be additionally reduced if a first admixing air hole is assigned to each fuel nozzle of the combustion chamber in the axial direction. If at that the number of first admixing air holes is preferably twice the size of the number of fuel nozzles, respectively a further first admixing hole is arranged in the circumferential direction, in the circumferential direction between the first admixing air holes that are respectively assigned to a fuel nozzle.

It is further preferred if the first and/or second admixing holes in the outer ring wall are respectively coaxial to the first and/or second admixing air holes in the inner ring wall. As a result, respectively one admixing air hole in the first admixed air row of the inner ring wall is assigned to each admixing air hole in the first admixed air row of the outer ring wall. The same preferably applies to the second admixed air rows of the second admixing air holes. Thus, a design of the admixing air holes can be realized in such a manner that the admixing air holes are for example designed in the outer ring wall of the annular combustion chamber according to the equation L, and a transition of the axial positions for the admixing air holes is realized in the inner ring wall. Thus, the distance L at the inner ring wall is the same as at the outer ring wall. Alternatively, the design of the admixing air holes can also be realized in such a manner that the admixing air holes in the inner ring wall of the annular combustion chamber can be designed according to the equation L, and a transition of the axial positions to the admixing air holes of the outer ring wall is realized. Also in this way, the distance L at the inner ring wall between the admixing air holes is the same as on the outer ring wall. Further, alternatively it is of course also possible that a design of the admixing air holes at the outer ring wall of the annular combustion chamber is realized separately from a design of the admixing air holes at the inner ring wall, but respectively according to the equation $L=D2/D1*(D2-D1)/C^2$.

It has further been stated that a positive effect on NOx emissions can be further improved if the first and/or second admixing air holes preferably partially project into the combustion space. The admixing air holes thus have a circumferential flange that projects into the combustion space, so that the discharge of the admixed air from the first and/or second admixing air holes is realized with some distance from the inner combustion chamber wall of the combustion chamber. Further, the height of the flange preferably varies in the circumferential direction of the flange.

Further, the present invention relates to a gas turbine, in particular an aircraft gas turbine, with a combustion chamber arrangement according to the present invention.

Figure 2:
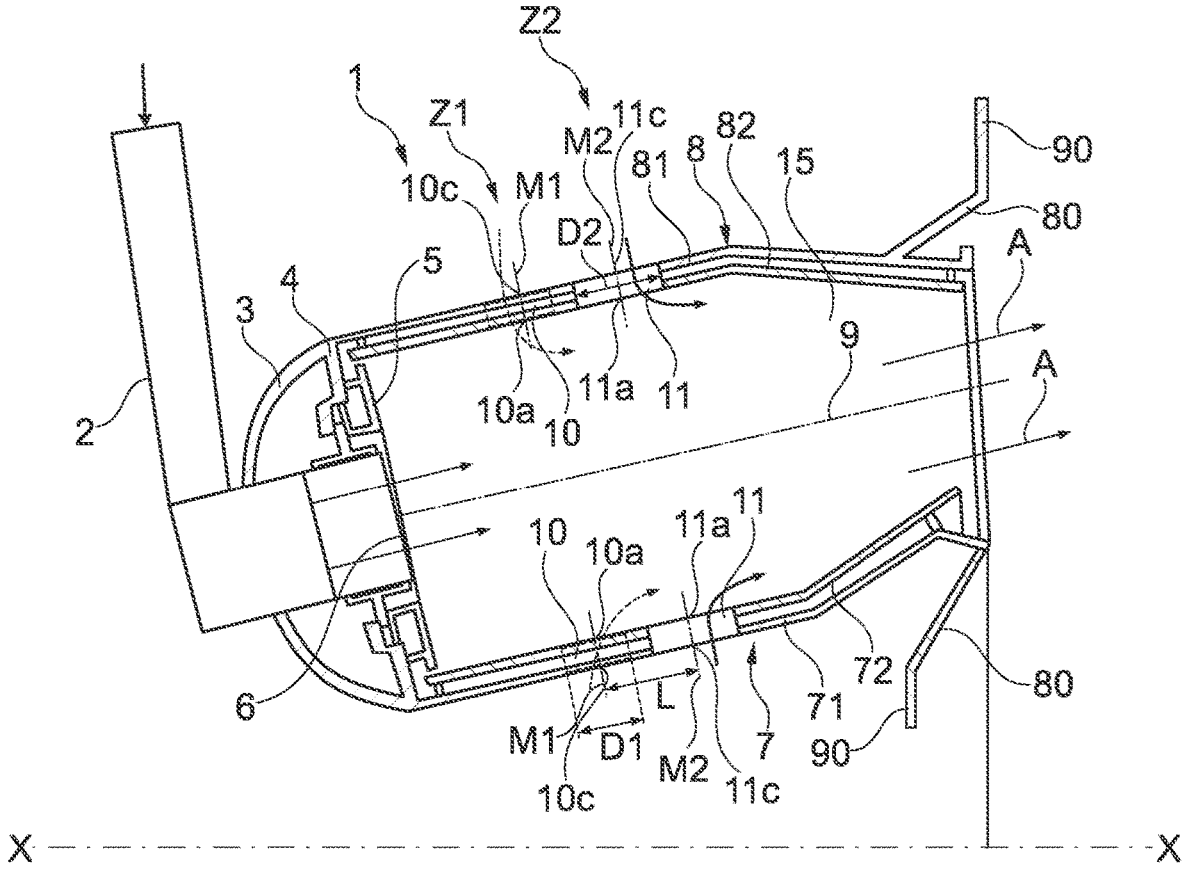
Figure 3:
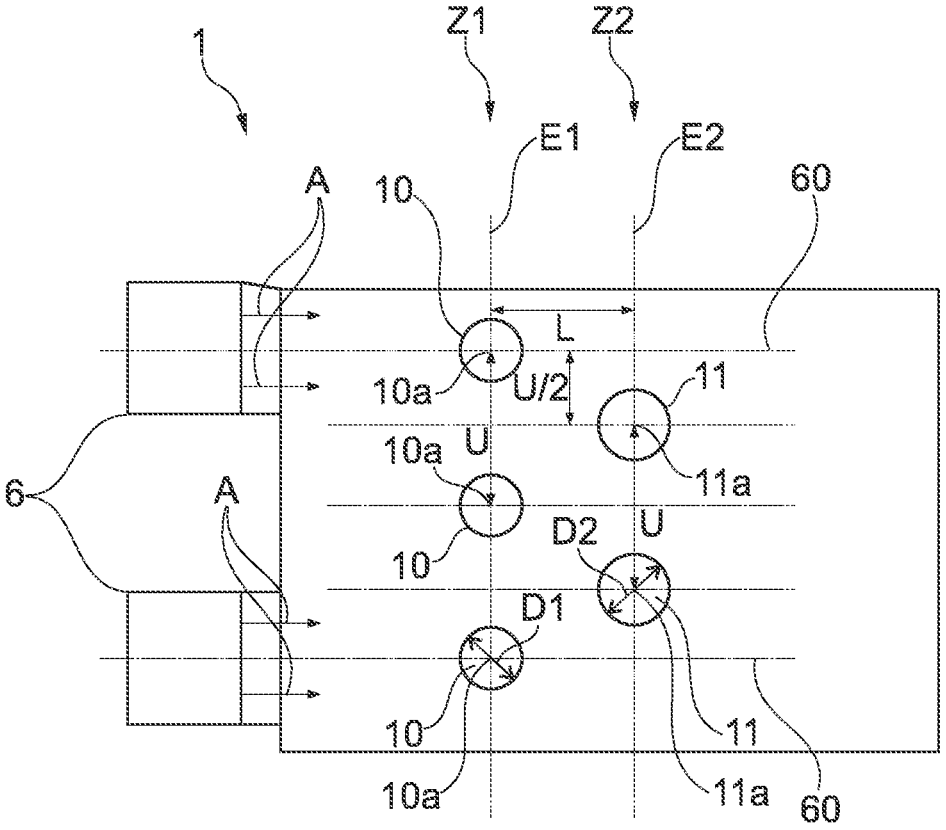
Figure 4:
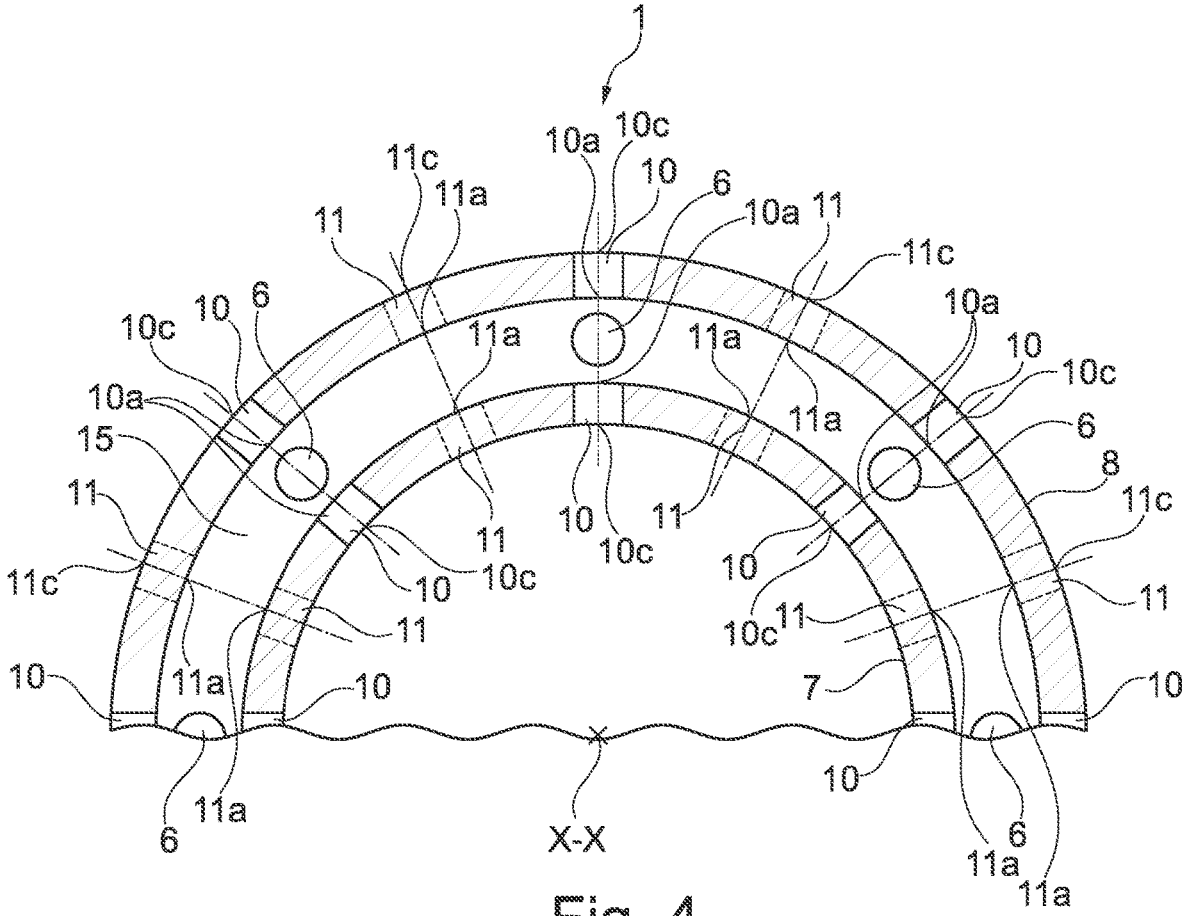
Figure 5:
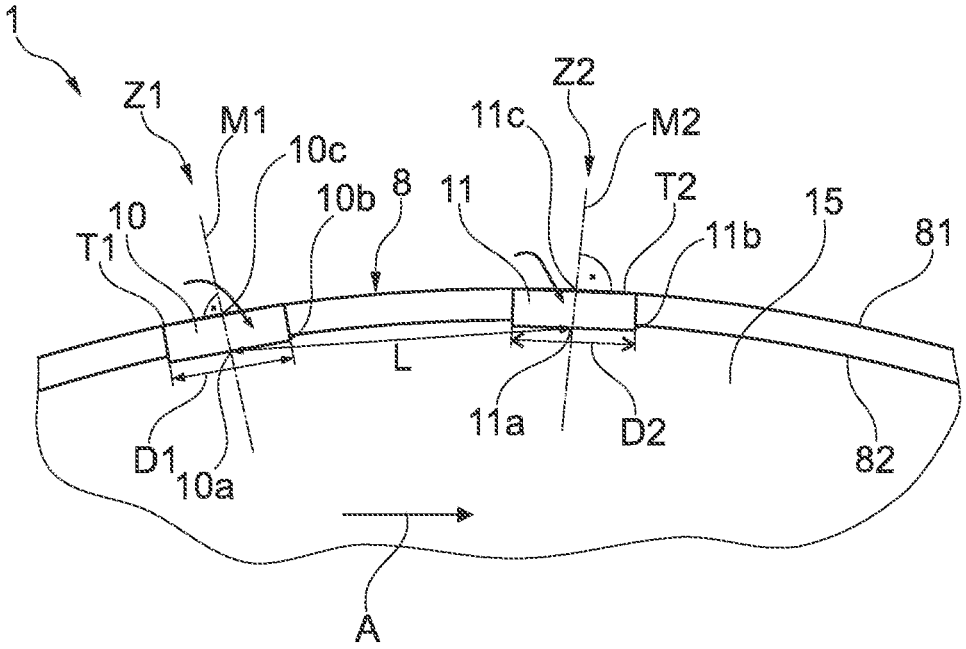
Figure 6:
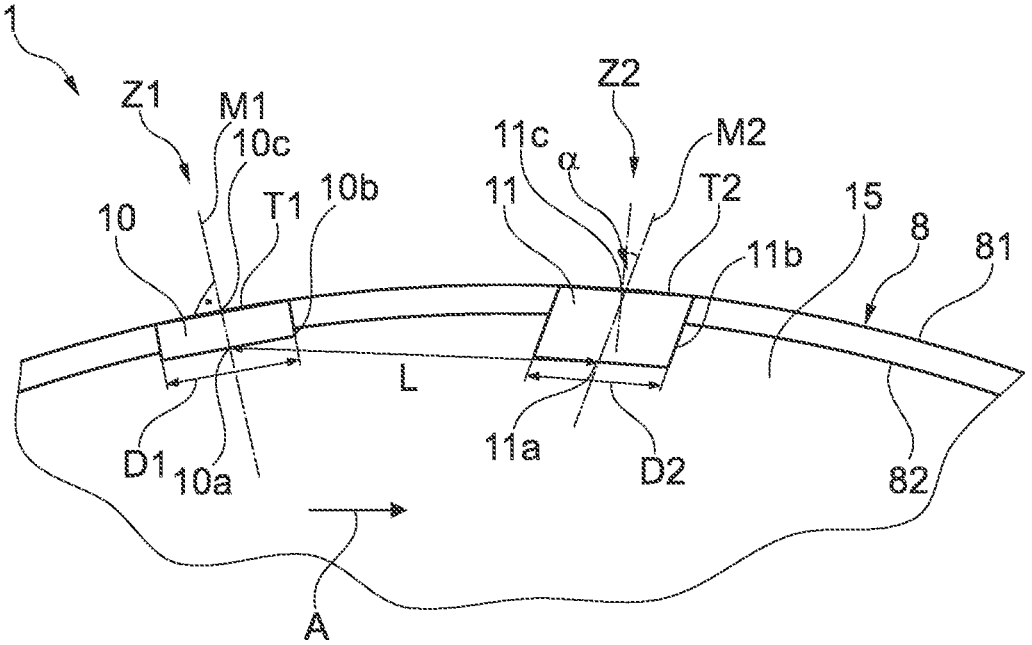
Figure 7:
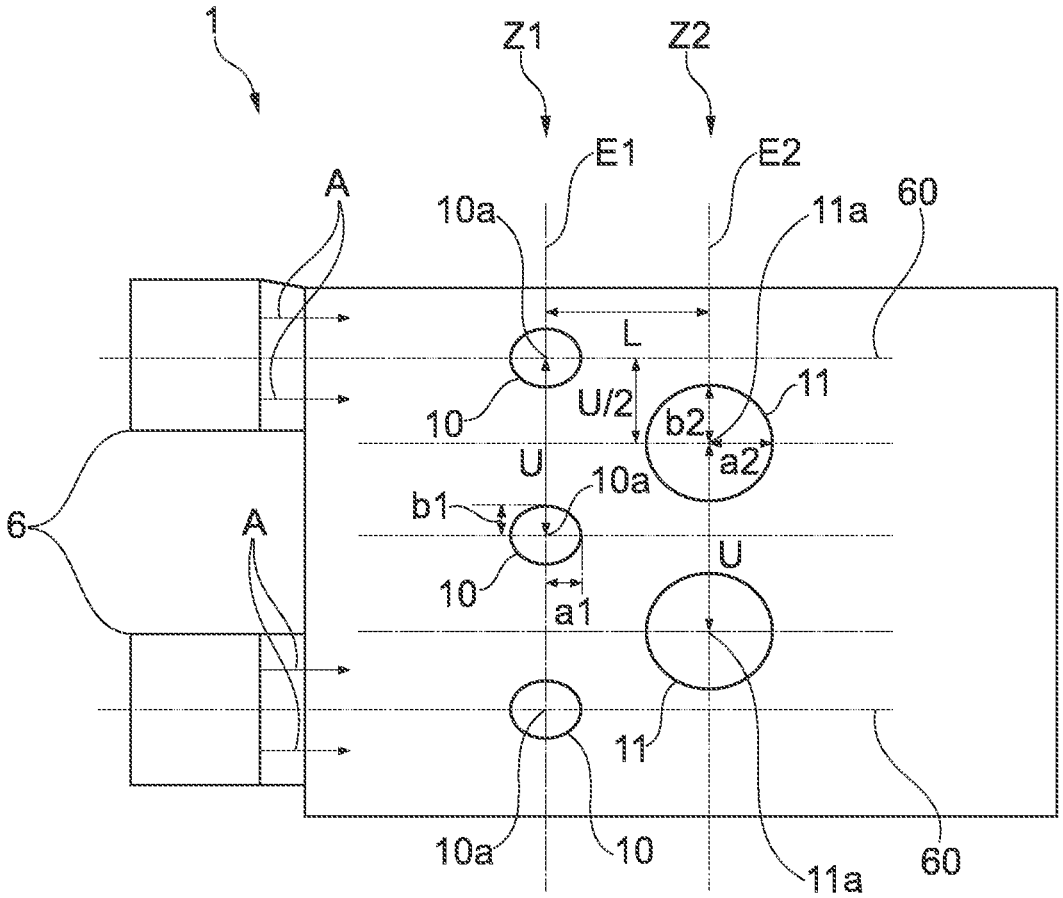
Figure 8:
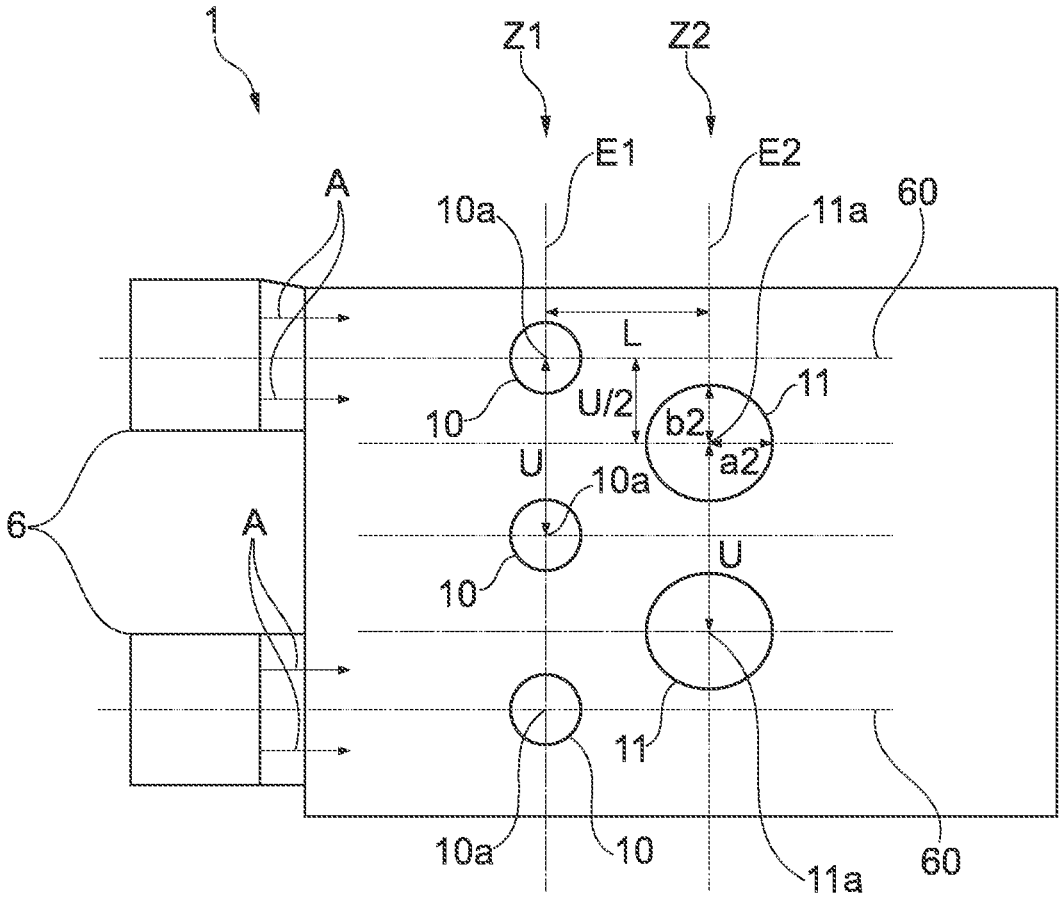

Subsequently, preferred exemplary embodiments of the invention are described in detail by referring to the accompanying drawing. At that, the same or functionally identical parts are respectively identified by the same reference signs. In the drawing:

FIG. 1 shows a schematic rendering of a gas turbine engine according to the present invention, FIG. 2 shows a schematic partial sectional view of a combustion chamber according to a first exemplary embodiment of the invention, FIG. 3 shows a schematic rendering of an arrangement of admixing air holes at the combustion chamber according to the first exemplary embodiment, FIG. 4 shows a schematic partial sectional view of the combustion chamber of FIG. 2, FIG. 5 shows a schematic partial sectional view of a combustion chamber according to a second exemplary embodiment of the invention, FIG. 6 shows a schematic partial sectional view of a combustion chamber according to a third exemplary embodiment of the invention, FIG. 7 shows a schematic rendering of an arrangement of admixing air holes according to a fourth exemplary embodiment of the invention, and FIG. 8 shows a schematic rendering of an arrangement of admixing air holes according to a fifth exemplary embodiment of the invention.

Subsequently, a gas turbine engine 100 and a combustion chamber arrangement 1 according to a first exemplary embodiment of the invention are described in detail by referring to FIGS. 1 to 4.

The gas turbine engine 100 according to FIG. 1 is an example of a turbomachine in which the invention can be used. However, the invention can also be used in other gas turbines, for example aircraft gas turbines.

The gas turbine engine 100 has, arranged in succession in the flow direction A, an air inlet 110, a fan 12 rotating inside a housing, a medium-pressure compressor 13, a high-pressure compressor 14, an annular combustion chamber 15, a high-pressure turbine 16, a medium-pressure turbine 17 and a low-pressure turbine 18 as well as an exhaust nozzle 19, which are all arranged about a central engine axis X-X.

The medium-pressure compressor 13 and the high-pressure compressor 14 respectively comprise multiple stages, of which each has an arrangement of fixedly arranged stationary guide vanes 20 that are generally referred to as stator vanes and project radially inward from the core engine shroud 21 through the compressors 13, 14 into a ring-shaped flow channel. Further, the compressors have an arrangement of compressor rotor blades 22 that project radially outward from a rotatable drum or disc 26, and are coupled to hubs 27 of the high-pressure turbine 16 or the medium-pressure turbine 17.

The three turbine sections of the high-pressure turbine 16, of the medium-pressure turbine 17 and the low-pressure turbine 18 have similar stages, comprising an arrangement of stationary guide vanes 23 that project radially inward from the housing 21 into an annular flow channel through the three turbine sections, and a subsequent arrangement of turbine blades/vanes 24 projecting outwards from the rotatable hub 27. During operation, the compressor drum or compressor disc 26 and the blades 22 arranged thereon as well as the turbine rotor hub 27 and the turbine rotor blades/vanes 24 arranged thereon rotate around the engine axis X-X.

FIGS. 2 and 3 show the combustion chamber arrangement 1 in detail. Apart from the annular combustion chamber 15, the combustion chamber arrangement 1 comprises a combustion chamber head 3 with a plurality of fuel nozzles 6, as shown in FIG. 2. Fuel is supplied to the fuel nozzles 6 via a fuel line 2.

The annular combustion chamber 15 comprises an inner ring wall 7 and an outer ring wall 8. The inner ring wall 7 is embodied with two walls and comprises an inner shingle support 71 and an inner combustion chamber shingle 72. The outer ring wall 8 is also designed with two walls and comprises an outer shingle support 81 and an outer combustion chamber shingle 82. It is to be understood that alternatively the inner ring wall and the outer ring wall can also be embodied with a single wall.

Further, a heat plate 4 and a heat shield 5 for thermal protection of the combustion chamber head 3 are also arranged at the combustion chamber head 3.

As can be seen in FIG. 2, the combustion chamber 15 is arranged so as to be tilted with respect to the engine axis X-X, so that a center of the combustion chamber 15 is defined by the middle cone mantle 9.

Further, the reference sign 80 identifies a combustion chamber suspension, and the reference sign 90 identifies a combustion chamber flange.

The combustion chamber arrangement 1 further comprises a first admixed air row Z1 with a plurality of first admixing air holes 10 that are embodied as passage holes. Further, the combustion chamber arrangement comprises a second admixed air row Z2 with a plurality of second admixing air holes 11 that are embodied as passage holes. The first and second admixing air holes are respectively arranged in the inner ring wall 7 and the outer ring wall 8.

Each of the first admixing air holes 10 has a first inner center point 10*a*, and each of the second admixing air holes 11 has a second inner center point 11*a*. As can be seen in FIGS. 3 and 4, all first inner center points 10*a* are arranged in a first plane E1 and all second inner center points 11*a* are arranged in a second plane E2.

Here, the first and second inner central points 10*a*, 11*a* are respectively located at a side of the admixing air holes 10, 11 that are oriented towards the combustion chamber 15. The first and second admixing air holes in the combustion chamber walls are now arranged in such a manner that the following equation is fulfilled:

$$L=D2/D1*(D2-D1)/C^2,$$

wherein L is a distance between the first and second inner center points 10*a*, 11*a* of the first and second admixing air holes 10, 11 in the axial direction of the combustion chamber 15, wherein D1 is a first flow diameter of the first admixing air holes 10 at the exit side to the combustion chamber 15, and D2 is a second flow diameter of the second admixing air holes 11 at the exit side to the combustion chamber 15. Further, C is an average flow rate coefficient of the first and second admixing holes.

Here, the flow diameter D1 and D2 of the first exemplary embodiment is chosen in such a manner that the flow diameter D1 of the first admixing air holes 10 and the second admixing air holes 11 is circular. Thus, the flow diameter is embodied as a circle diameter.

At that, a first diameter D1 is smaller than the second diameter D2.

In circumferential direction, the admixing air holes 10 of the first admixed air row Z1 are arranged at the same distance, and have a distance U from the first inner center points 10*a* that are respectively adjacent to one another (cf. FIG. 3). Here, the second admixing air holes 11 of the second admixed air row Z2 have the same distance in the circumferential direction U. Here, the first and second inner center points 10*a*, 11*a* are respectively offset by a distance U/2 in the circumferential direction (cf. FIG. 3).

Further, the first admixing air holes 10 are arranged in such a manner that a first admixing air hole 10 is always arranged in alignment with the through-flow direction A of the combustion chamber on the central axis 60 of each fuel nozzle 6 (cf. FIG. 3). Alternatively, it is also possible that this condition is only fulfilled on the inner ring wall, or only on the outer ring wall.

Here, the average flow rate coefficient C of the first and second admixing holes lies in a range of 0.60 to 0.75, and especially preferably is 0.69. The flow rate coefficient C is approximately the same in each of the admixing air holes 10, 11, so that the flow rate coefficient C can always be preferably chosen to be 0.69, also taking into consideration tolerance bands.

It is to be understood that the flow diameter D1, D2 does not necessarily have to be a circle diameter, but can for example be an ellipse diameter.

In the first exemplary embodiment, the first and second admixing air holes 10, 11 are cylindrical (cf. FIG. 4). If the first and second admixing air holes are not chosen to be cylindrical, but for example conical or convex, the smallest diameter of the admixing holes is respectively chosen as the first and second flow diameter.

The number of the first admixing holes 10 equals the number of the second admixing holes 11. The second admixing holes 11 of the second admixing row Z2 are arranged so as to be respectively centrally offset in the circumferential direction with respect to the admixing air holes 10 of the first admixed air row Z1, which is schematically shown in FIG. 3. The number of the first and second admixing air holes 10, 11 is defined by the amount of air that is available in total for admixing, and can be calculated as follows as the sum of the partial surfaces of the first and second admixing air holes multiplied by the number of holes:

$$B=N*(0.25*\pi*D1^2+0.25*\pi*D2^2).$$

For the design, either the distance L between the two admixed air rows and the surface B with the number of holes N of an admixed air row, e.g. N1 of the first admixed air row, or the surface B and the number of holes N and one of the diameters D1, D2 of the first and second admixing air holes or the ratio of the diameter of the first and second admixing air holes with respect to each other can be indicated.

For example, the surface B, the number N of the admixing air holes of the first (N1) or second (N2) admixed air row, which in this exemplary embodiment is identical in both admixed air rows, and the ratio D2/D1 are specified:

Total area B: 12.000 $mm^2$

Number N of the admixing holes of the first or second admixed air row: 48

$$D2/D1=1.3.$$

Since the flow rate coefficient is known as 0.69, what results for the first diameter D1 is a value of 10.9 mm, what results for the second diameter D2 is a value of 14.1 mm, and what results for the length L is a value of 8.74 mm.

Thus, it can be ensured according to the invention that a sufficient amount of admixed air can be introduced into the combustion chamber 15, so that the generation of undesired NOx emissions can be significantly reduced. Through the even distribution of the first and second admixing air holes 10, 11 along the circumference, it can thus be avoided that any areas rich in combustion fuel and areas of high combustion temperatures remain in the combustion chamber 15. The advantageous arrangement of the admixing air holes thus makes it possible to achieve a uniform leaning in the combustion chamber 15.

As can be seen in FIG. 2, the first central axes M1 of the first admixing air holes 10 are arranged in such a manner that they lie in the plane E1. Further, the central axes M2 of the second admixing air holes 11 lie in the second plane E2. Since the distance L is respectively determined at the inner center points 10*a*, 11*a* of the first and second admixing air holes 10, 11, it is possible to determine the distance L if the central axes M1, M2 of the admixing air holes 10, 11 are tilted with respect to the middle cone mantle 9. In the first exemplary embodiment, the first central axes M1 and the second central axes M2 intersect with the middle cone mantle 9 of the combustion chamber 15 in a respectively perpendicular manner.

Thus, according to the invention, a connection between the flow diameters D1, D2 of the first and second admixing air holes 10, 11 and the distance L is established in the through-flow direction A of the combustion chamber 15 in order to achieve an optimization of the reduction of NOx emissions.

FIG. 5 shows a combustion chamber arrangement 1 according to a second exemplary embodiment of the invention. As can be seen from FIG. 5, the combustion chamber 15 of the second exemplary embodiment has a barrel-like ring shape. This results in different inflow directions of the admixed air of the first admixed air row Z1 and the second admixed air row Z2 into the combustion chamber 15. As can be seen in FIG. 5, the first admixing air holes 10 are arranged in such a manner that they are arranged perpendicular to a first tangent T1 of the combustion chamber outer wall 8. The second admixing holes 11 are arranged perpendicular to a second tangent T2 at the combustion chamber outer wall 8. This results in different inclinations of the first and second admixing air holes, whereby a different mixing with admixed air is obtained in the combustion chamber 15. Further, in the second exemplary embodiment, the first and second admixing air holes are embodied in such a manner that they partially protrude into the interior of the combustion chamber 15. At that, the first admixing air hole 10 has an inner flange 10*b* which protrudes into the combustion chamber 15. The second admixing hole 11 has an inner flange 11*b* which projects into the combustion chamber 15. As a result, the piercing point of the central lines M1 and M2 of the first and second admixing air holes 10, 11, and thus the inner center points 10*a*, 11*a*, is offset further inwards into the combustion chamber 15, whereby a different length L results as the distance in the through-flow direction A between the first and second admixed air row Z1, Z2.

FIG. 6 shows a combustion chamber arrangement 1 according to a third exemplary embodiment of the invention. The third exemplary embodiment substantially corresponds to the second exemplary embodiment, wherein in contrast to the latter, the second admixing air holes 11 are arranged in a tilted manner with respect to the second tangent T2 at the combustion chamber outer wall 8. As a result, the piercing point at the exit of the second admixing air holes 11 is shifted, so that the second inner center point 11*a* is arranged closer to the first admixed air row Z1. As a result, the distance L becomes shorter. Further, the first and second admixing air holes 10, 11 are again embodied in such a manner that they partially project into the combustion chamber 15. Here, the flange 11*b* of the second admixing holes 11 projects further into the combustion chamber than the flange 10*b* of the first admixing air holes 10.

FIG. 7 schematically shows a combustion chamber arrangement according to a fourth exemplary embodiment of the invention. In contrast to the previous exemplary embodiments, in the fourth exemplary embodiment the flow diameters of the first and second admixing air holes 10, 11 are not any longer provided as circle diameters, but rather as ellipse diameters. At that, an elliptical surface of the second admixing air holes 11 is larger than that of the first admixing air holes 10. Here, the flow diameter D1 and D2 of the first and second admixing air holes 10, 11 is calculated for the elliptical shape as follows:

$$D1=4*a1*b1/(a1+b1),$$

wherein a1 and b1 are the semi-axes of the ellipse of the first admixing holes 10.

The second flow diameter D2 is calculated as follows:

$$D2=4*a2*b2/(a2+b2),$$

wherein a2 and b2 are the semi-axes of the ellipse of the second admixing air holes 11.

As in the first exemplary embodiment, in the fourth exemplary embodiment the second admixing air holes 11 of the second admixed air row Z2 are centrally offset in the circumferential direction with respect to the admixing air holes 10 of the first admixed air row Z1. Again, the inner first and second center points 10*a* and 11*a* lie in a first plane E1 or a second plane E2. At that, each second first admixing hole 10 of the first admixing hole row Z1 is again positioned so as to be aligned with the central axis 60 of the fuel nozzles 6. Thus, exactly one first admixing air hole 10 is assigned to each fuel nozzle 6 in the axial direction.

FIG. 8 schematically shows a combustion chamber arrangement according to a fifth exemplary embodiment of the invention. In contrast to the fourth exemplary embodiment, in the fifth exemplary embodiment the first admixing air holes 10 are provided to be circular, and the second admixing air holes 11 are embodied in an elliptical manner. At that, the circle diameters and the ellipse diameters have the same size along the respective admixed air rows Z1, Z2 in every admixing air hole. Here, the longer semi-axis of the ellipse is aligned in the through-flow direction A. Further, it is to be understood that it is also possible that the first admixed air row Z1 has elliptical admixing air holes and the second admixed air row Z2 has circular admixing air holes.

It is stated with regard to all described exemplary embodiments that any desired combination between circle diameters and ellipse diameters are also possible. Also, the longer semi-axis of the ellipse can be arranged perpendicular to the through-flow direction A. Alternatively, circle diameters and ellipse diameters can be arranged in an alternating manner in at least one admixed air row, or admixing air holes are embodied so as to alternatingly have circle diameters and ellipse diameters, which can also be offset in the circumferential direction, in both admixed air rows Z1, Z2.

PARTS LIST

1 combustion chamber arrangement
2 fuel line
3 combustion chamber head
4 heat plate
5 heat shield
6 fuel nozzle
7 double-walled inner ring wall
8 double-walled outer ring wall
9 middle cone mantle
10 first admixing air holes
10*a* first inner center points
10*b* flange
10*c* first outer center points
11 second admixing air holes
11*a* second inner center points
11*b* flange
11*c* second outer center points
12 fan rotating inside the housing

13 medium-pressure compressor
14 high-pressure compressor
15 combustion chamber
16 high-pressure turbine
17 medium-pressure turbine
18 low-pressure turbine
19 exhaust nozzle
20 guide vanes
21 engine housing
22 compressor rotor blades
23 guide vanes
24 turbine blades/vanes
26 compressor drum or compressor disc
27 turbine rotor hub
28 outlet cone
60 central axis of the fuel nozzle
72 inner shingle support
72 inner combustion chamber shingle
80 combustion chamber suspension
81 outer shingle support
82 outer combustion chamber shingle
90 combustion chamber flange
100 gas turbine engine
110 air inlet
A through-flow direction
B surface of all admixing holes
C average flow rate coefficient
D1 first flow diameter
D2 second flow diameter
E1 first plane
E2 second plane
L distance of the inner center points
M1 first central axis
M2 second central axis
N number of the admixing holes of an admixed air row
N1 number of the admixing holes of the first admixed air row Z1
N2 number of the admixing holes of the second admixed air row Z2
T1 first tangent
T2 second tangent
X-X engine axis
Z1 first admixed air row
Z2 second admixed air row

The invention claimed is:

1. A combustion chamber arrangement of a gas turbine, comprising an annular combustion chamber with an inner ring wall and an outer ring wall, a combustion chamber head with a plurality of fuel nozzles, a first admixed air row with a plurality of first admixing air holes which are configured as passage holes and which are arranged in at least one chosen from the inner ring wall and the outer ring wall, a second admixed air row with a plurality of second admixing air holes which are configured as passage holes and which are arranged in at least one chosen from the inner ring wall and the outer ring wall, wherein the plurality of first admixing air holes have first inner center points and first outer center points, and the plurality of second admixing air holes have second inner center points and second outer center points, wherein the first and second inner center points respectively lie at a side of the plurality of first and second admixing air holes that is oriented towards the combustion chamber, and the first and second outer center points lie at a side of the plurality of first and second admixing air holes that is facing away from the combustion chamber, wherein the equation $L=D2/D1*(D2-D1)/C^2$ is fulfilled, wherein L is a distance between at least one chosen from:

the first and second inner center points, and the first and second outer center points, wherein D1 is a first flow diameter of the plurality of first admixing air holes at at least one chosen from an entry side and an exit side to the combustion chamber, and D2 is a second flow diameter of the second admixing air holes at at least one chosen from the entry side and the exit side to the combustion chamber, wherein the second flow diameter D2 is larger than the first flow diameter D1, and wherein C is a measure for an average flow rate coefficient of the plurality of first and second air admixing holes, wherein a first portion of the plurality of first admixing air holes are positioned in the outer ring wall and a second portion of the plurality of first admixing aft holes are positioned in the inner ring wall and the first portion of the plurality of the first admixing air the plurality of first admixing air holes in the outer ring wall intersect central axes of the plurality of fuel nozzles in a through-flow direction of the combustion chamber, and wherein axes of the second portion of the plurality of first admixing air holes in the inner ring wall are offset from the central axes respectively in a circumferential direction by an angle $\alpha=360°/(2*N1)$, wherein N1 is a number of the plurality of first admixing air holes of the first admixed aft row.

2. The combustion chamber arrangement according to claim 1, and further comprising at least one chosen from:

wherein the first flow diameter D1 is a first circle diameter of the plurality of first admixing air holes, or wherein the first flow diameter D1 is a first ellipse diameter of the plurality of first admixing air holes according to an equation $D1=4*(a1*b1)/(a1+b1)$, wherein a1 and b1 are semi-axes of the ellipse, and wherein the second flow diameter D2 is a second circle diameter of the plurality of second admixing air holes, or the second flow diameter D2 is a second ellipse diameter of the plurality of second admixing air holes according to an equation $D2=4*(a2*b2)/(a2+b2)$, wherein a2 and b2 are semi-axes of the ellipse.

3. The combustion chamber arrangement according to claim 1, wherein the average flow rate coefficient C is in a range of 0.60 to 0.75.

4. The combustion chamber arrangement according to claim 1, and further comprising:

wherein at least one chosen from the first flow diameter D1 and the second flow diameter D2 in a through-flow direction through the admixing air holes is constant, and wherein one of the plurality of first admixing air holes is assigned to each fuel nozzle in an axial direction.

5. The combustion chamber arrangement according to claim 1, wherein a number of the plurality of first admixing air holes is equal to a number of the plurality of second admixing air holes at at least one chosen from the outer ring wall and the inner ring wall.

6. The combustion chamber arrangement according to claim 5, wherein the plurality of second admixing air holes are offset with respect to the plurality of first admixing air holes in the circumferential direction at at least one chosen from the outer ring wall and the inner ring wall.

7. The combustion chamber arrangement according to claim 5, wherein the second admixing air holes at at least one chosen from the outer ring wall and the inner ring wall.

8. The combustion chamber arrangement according to claim 1, wherein the plurality of first admixing air holes have first central axes that lie in a first plane, and wherein the plurality of second admixing air holes have second central axes that lie in a second plane.

9. The combustion chamber arrangement according to claim 8, wherein at least one chosen from the first central axes and the second central axes are perpendicular to at least one chosen from a tangent at the inner ring wall and a tangent at the outer ring wall.

10. The combustion chamber arrangement according to claim 1, and further comprising:

wherein the combustion chamber has at least one chosen from:

a barrel shape, and wherein at least one chosen from the plurality of first admixing air holes and the plurality of second admixing air holes have central axes that are arranged at an angle not equal to 90° with respect to a tangent at the outer ring wall of the combustion chamber.

11. The combustion chamber arrangement according to claim 1, wherein a first portion of the plurality of second admixing air holes are positioned in the outer ring wall and a second portion of the plurality of second admixing air holes are positioned in the inner ring wall and the first portion of the plurality of second admixing air holes are respectively coaxial to the second portion of the plurality of second admixing air holes in the inner ring wall.

12. The combustion chamber arrangement according to claim 1, wherein a number of the plurality at first admixing air holes corresponds to twice a number of the plurality of the fuel nozzles.

13. A gas turbine, comprising the combustion chamber arrangement according to claim 1.

14. The combustion chamber arrangement according to claim 1, wherein the average flow rate coefficient C is 0.69.

15. The combustion chamber arrangement according to claim 1, wherein the plurality of first admixing air holes have first central axes that lie in a first plane, and wherein the second admixing air holes have second central axes that lie in a second plane, wherein the first and second planes are parallel to each other.

16. A combustion chamber arrangement of a gas turbine, comprising an annular combustion chamber with an inner ring wall and an outer ring wall, a combustion chamber head with a plurality of fuel nozzles, a first admixed air row with a plurality of first admixing air holes which are configured as passage holes and which are arranged in at least one chosen from the inner ring wall and the outer ring wall, a second admixed air row with a plurality of second admixing air holes which are configured as passage holes and which are arranged in at least one chosen from the inner ring wall and the outer ring wall, wherein the plurality of first admixing air holes have first inner center points and first outer center points, and the plurality of second admixing air holes have second inner center points and second outer center points, wherein the first and second inner center points respectively lie at a side of the plurality of first and second admixing air holes that is oriented towards the combustion chamber, and the first and second outer center points lie at a side of the plurality of first and second admixing air holes that is facing away from the combustion chamber, wherein the equation $L=D2/D1*(D2-D1)/C^2$ is fulfilled, wherein L is a distance between at least one chosen from:

the first and second inner center points, and the first and second outer center points, wherein D1 is a first flow diameter of the plurality of first admixing air holes at at least one chosen from an entry side and an exit side to the combustion chamber, and D2 is a second flow diameter of the second admixing air holes at at least one chosen from the entry side and the exit side to the combustion chamber, wherein the second flow diameter D2 is larger than the first flow diameter D1, and wherein C is a measure for an average flow rate coefficient of the plurality of first and second air admixing holes, wherein a first portion of the plurality of first admixing air holes are positioned in the outer ring wall and a second portion of the plurality of first admixing air holes are positioned in the inner ring wall and the second portion of the plurality of first admixing air holes in the inner ring wall are respectively arranged such that axes of the second portion of the plurality of first admixing air holes in the inner ring wall intersect central axes of the plurality of fuel nozzles in a through-flow direction of the combustion chamber, and wherein axes of the first portion of the plurality of first admixing air holes in the outer ring wall are offset from the central axes in a circumferential direction by an angle $\alpha=360°/(2*N1)$, wherein N1 is a number of the plurality of first admixing air holes of the first admixed air row.

17. The combustion chamber arrangement according to claim 16, wherein a first portion of the plurality of second admixing air holes are positioned in the outer ring wall and a second portion of the plurality of second admixing air holes are positioned in the inner ring wall and the first portion of the plurality of second admixing air holes are respectively coaxial to the second portion of the plurality of second admixing air holes in the inner ring wall.

18. A gas turbine, comprising the combustion chamber arrangement according to claim 16.

* * * * *